US007763131B2

(12) United States Patent
Boyer et al.

(10) Patent No.: US 7,763,131 B2
(45) Date of Patent: Jul. 27, 2010

(54) METHOD AND APPARATUS FOR LIMITING THE VIBRATION OF STEEL OR ALUMINUM STRIPS IN A BLOWN-GAS OR -AIR COOLING ZONES

(75) Inventors: Michel Boyer, Chartrettes (FR); Patrick Dubois, Andrezel (FR)

(73) Assignee: CMI Thermline Services, Avon (FR)

( * ) Notice: Subject to any disclaimer, the term of this patent is extended or adjusted under 35 U.S.C. 154(b) by 531 days.

(21) Appl. No.: 11/577,348

(22) PCT Filed: Oct. 12, 2005

(86) PCT No.: PCT/FR2005/002523

§ 371 (c)(1),
(2), (4) Date: Apr. 16, 2007

(87) PCT Pub. No.: WO2006/042937

PCT Pub. Date: Apr. 27, 2006

(65) Prior Publication Data

US 2007/0241485 A1 Oct. 18, 2007
US 2009/0065983 A2 Mar. 12, 2009

(30) Foreign Application Priority Data

Oct. 19, 2004 (FR) ..... 04 11038

(51) Int. Cl.
*C21D 1/667* (2006.01)

(52) U.S. Cl. ..... 148/661; 266/113

(58) Field of Classification Search ..... 266/111, 266/113; 148/661, 660
See application file for complete search history.

(56) References Cited

U.S. PATENT DOCUMENTS 3,068,586 A * 12/1962 Vaughan et al. ..... 34/435
3,116,788 A 1/1964 Beggs et al.

(Continued)

FOREIGN PATENT DOCUMENTS

| | | | |
|---|---|---|---|
| EP | 0803583 | A2 | 10/1997 |
| EP | 1029933 | A1 | 2/2000 |
| EP | 1067204 | A1 | 6/2000 |
| EP | 1108795 | A1 | 11/2000 |
| WO | 01/09397 | | 2/2001 |

OTHER PUBLICATIONS

International Search Report for Serial No. PCT/FR2005/002523 dated Mar. 15, 2006.

*Primary Examiner*—Scott Kastler
(74) *Attorney, Agent, or Firm*—McCormick, Paulding & Huber LLP

(57) ABSTRACT

The invention relates to a method of improving the cooling of a blown-gas cooling chamber or of a blown-air cooling section in a line for heat treating steel and/or aluminum, and/or of improving the quality of products for treatment by reducing the vibration generated by the cooling, in which jets of gas or air are projected against each of the faces of the strip traveling through said section or chamber. In accordance with the invention, the jets (58) of gas or air are emitted from blow tubes (52) fitted to tubular nozzles (51) arranged at a distance transversely on either side of the travel direction (100) of the strip (53), said jets being directed towards the corresponding face of the strip while being inclined simultaneously essentially towards the edges of said strip in a plane perpendicular to the panel of the strip and to the travel direction (100) of said strip, and towards the upstream or downstream end of the strip in a plane perpendicular to the plane of the strip and parallel to the travel direction (100) of said strip.

12 Claims, 4 Drawing Sheets

U.S. PATENT DOCUMENTS 3,262,688 A 7/1966 Beggs
3,300,198 A * 1/1967 Clumpner et al. ..... 134/64 R
4,673,447 A 6/1987 Sakai et al.
5,502,881 A * 4/1996 Gaydoul ..... 29/81.08
6,054,095 A 4/2000 Minato et al.
6,309,483 B1 * 10/2001 Wang et al. ..... 148/661

* cited by examiner

METHOD AND APPARATUS FOR LIMITING THE VIBRATION OF STEEL OR ALUMINUM STRIPS IN A BLOWN-GAS OR -AIR COOLING ZONES

CROSS REFERENCE TO RELATED APPLICATIONS

This application is entitled to the benefit of and incorporates by reference essential subject matter disclosed in International Patent Application No. PCT/FR2005/002523 filed on Oct. 12, 2005 and French Patent Application No. 0411038 filed Oct. 19, 2004.

FIELD OF THE INVENTION

The present invention relates generally to a method of improving the cooling of a blown-gas cooling chamber or of a blown-air cooling section of a line for applying heat treatment to steel or aluminum, and/or for improving the quality of the products for treatment.

More precisely, the method of the invention relates to lines for applying treatment to strips of steel or aluminum that make use of at least one chamber for cooling by means of jets of gas or air, or of a section for cooling by jets of gas or of air, such as heat treatment lines, in particular lines for continuous annealing, or such as lines for coating, in particular lines for applying metallic or non-metallic coatings.

The method seeks to increase cooling of the strip while avoiding vibratory phenomena on the strip.

BACKGROUND OF THE INVENTION

There follows, with reference to FIGS. 1 to 8, a general description of lines for applying treatment to strips of steel or aluminum.

A vertical cooling chamber of a line for applying treatment of strips of steel or aluminum made in accordance with the prior art is constructed on the principle shown in FIG. 1, in which there can be seen a cooling chamber 4 of a treatment oven, through which there passes a strip 1 of steel or aluminum, which strip is subjected to the action of cooling elements 2 on passing over top deflection rollers 3 and bottom deflection rollers 3'. The strip 1 is cooled in the chamber 4 mainly by the cooling elements 2 that are constituted by assemblies for blowing gas at a temperature lower than the temperature of the strip.

On passing through the cooling chamber 4, the strip 1 is cooled on both faces by the cooling elements 2 situated on either side of the line of travel, and when cooling is performed on a plurality of lines of travel, said strip changes its line of travel each time it goes past a deflection roller 3 or 3'. The strip cooling curve in the chamber is controlled by indexing the various cooling elements 2 or groups of cooling elements operating in identical manner.

A vertical cooling section of a line of travel for strips of steel or aluminum made in accordance with the prior art is constructed on the principle shown in FIG. 2, in which there can be seen a vertical cooling section 10 through which there passes a strip 11 that is subjected to the action of cooling elements 12. The strip 11 is cooled within the section mainly by the cooling elements 12 that are constituted by assemblies for blowing air at a temperature lower than the temperature of the strip. The ideal line of travel for the strip 11 is determined by the top deflection roller 13 and the bottom deflection roller 13'.

On passing through the cooling section 10, the strip 11 is cooled on both faces by the cooling elements 12 situated on either side of the line of travel. The cooling curve for the strip in the section is controlled by indexing the various cooling elements 12 or groups of cooling elements that operate in identical manner.

The productivity of the cooling section or chamber is determined by the capacity for transferring heat in cooling so as to ensure that the strip at the outlet of the cooling section or chamber achieves temperatures and the cooling rates (expressed in ° C./second) that are suitable for determining the metallurgical quality of the finished product. The heat transfer depends on the blow distance between the strip and the cooling system, on the geometrical configuration of the blowing, and on the blow speed. Heat transfer is also made more effective if the blow distance is short and/or if the blow speed is large.

Increasing the blow speed and decreasing the distance between the strip and the blow system beyond a certain limit leads to vibration and/or oscillation of the strip that can lead to the strip coming into contact with the blow system (or with means for protecting the blow system), thereby leading to marking (scratching) that is incompatible with the desired surface quality, and even in extreme circumstances leading to the strip breaking.

Increasing the performance of lines for treating steel or aluminum requires faster cooling rates on products that are becoming finer and finer and wider and wider.

For example, when annealing strips of steel, it is not uncommon to specify, for the cooling chamber of a continuous annealing oven, cooling rate requirements that are severe (typically greater than 80° C./second) for steels said to be of drawing quality (DQ), deep drawing quality (DDQ), and high strength steel (HSS). Cooling rates are slower (typically 20° C./second) for so-called commercial quality (CQ) steels. Document EP 0 803 583 A2 describes this need and the various applications.

It should be observed that the proportion of steels having a high stamping limit (e.g. of the DDQ type) or having a high elastic limit (e.g. of the HSS type) is increasing significantly.

Likewise, in order to save weight, in particular in automobile applications, the mean thickness of steels is decreasing, whereas the mean width of the sheets for treatment is increasing with optimization of the stamping means.

Finally, the capacities of treatment lines, and in particular of annealing or galvanization lines is increasing towards ever greater capacities.

This increase, combined with the various parameters mentioned above, is leading to a new problem appearing in cooling sections or chambers, namely strip vibration, where this phenomenon used to be limited or even unknown in equipment made in accordance with the prior art.

Naturally, this phenomenon is very critical for vertical sections or chambers as shown in FIGS. 1 and 2, but it also exists with a horizontal line of travel, even though the phenomenon is then attenuated by the weight of the strip.

The post-coating cooling zone in a hot galvanization line as shown in FIG. 3 is also very sensitive to this phenomenon. After a steel strip 21 has been coated by being immersed in a bath 22 of molten zinc alloy, the thickness of the coating is controlled by wiping the liquid coating in air or nitrogen. This wiping is generally performed by a pair of blow nozzles 23, 23'. The following vertical cooling zone 24 is for the purpose of solidifying the coating and ensuring that, on reaching the deflection roller 25 at the top of the tower, the strip is at a temperature that is compatible with the process, in particular that avoids leaving any traces on the coating.

On large-capacity lines, increasing capacity means that the height of the free strand of strip 21 between the last roller 26 immersed in the molten zinc bath 22 and the high deflector roller 25 in the tower exceed 50 meters (m).

It is desirable to reduce this height both for technical and for economic reasons, but that would lead to increasing heat exchange coefficients, and once again that would generate levels of vibration that are incompatible with the quality of the finished product. Such vibration can lead to marking by the strip coming into contact with external elements, and it is also harmful to the regularity of the zinc coating. One of the essential parameters of wiping is distance between the blow nozzle 23 or 23' and the strip 21, following a line of travel that, ideally, is unchanging. The vibration of the strip 21 leads to a change in the line of travel in the longitudinal and/or transverse direction of the strip, and thus to coating that is not uniform.

In order to limit the undesirable effects of strip vibration, attempts have been made in a prior technique to limit vibration by reducing the length of the blow boxes (or zones), so as to be able to install stabilizing rollers. Nevertheless, that technique limits the length subjected to cooling and thus limits the effectiveness of the cooling in the zone, and furthermore that technique requires the strip to come into contact with the stabilizer rollers, which is incompatible with applications in cooling zones following hot galvanization since the coating is not totally solidified.

Air-flow stabilization systems have also been proposed for replacing the above-mentioned stabilizer rollers. Those systems are relatively effective and they can contribute to cooling, however they are not optimized for enhancing the heat exchange coefficient, and thus for optimizing cooling. In addition, energy consumption is relatively large.

Another attempt has consisted in increasing traction on the strip, however that solution can be envisaged only for strips that are of considerable thickness, and for strip temperatures that are low, since the thermomechanical stresses generated on fine strips at high temperature can exceed the elastic limit of the strips and can lead to deformation that is permanent, or even to the strip breaking.

Another solution consists in controlling vibration of the strip by adapting the blow speed, and/or the distance between the strip and the blow elements, and/or the blow rate in the event of vibration appearing. That leads to limiting the effectiveness of cooling, and thus to limiting the performance of the installation.

As shown in FIG. 4, another solution has been proposed for encouraging the blown gas to flow laterally. That solution consists in arranging blow tubes 31, 31' on blow boxes 32, 32' situated on either side of the strip 33 which travels in the direction referenced 100. The blow tubes 31, 31' can thus guide the blow jets 34, 34' that are emitted in a direction that is perpendicular to the plane of the traveling strip 33. Although that system leads to an improvement compared with boxes that merely have holes, it constitutes a solution that is not satisfactory, and the strip is observed to wander in such systems, thus leading either to damage to the tubes when the strip is thick, or to the strip breaking when the strip is fine. Since the gas, once blown, can be exhausted only towards the sides of the boxes, either in the travel direction of the strip or else laterally, it follows that a large flow of gas travels parallel to the strip in a volume that is confined between the strip and the boxes on its way to the edges of said boxes. The presence of the tubes 31, 31' does in fact increase the volume available that is confined between the strip and the boxes, compared with boxes that merely have holes.

The disturbances that have been observed with the arrangement of FIG. 4 are illustrated in FIGS. 5 and 6 which are end views seen looking along arrow A in FIG. 4.

In FIG. 5, simulations involving fluid mechanics as applied to industrial configurations demonstrate that when the strip 33 is off-center towards one or other of the boxes, in this case the box 32', the resultant of the pressures acting on the strip exerts a force F tending to move the strip even closer to said box. The system is thus unstable and does not tend to stabilize the strip on a line of travel that is centered between the boxes. In FIG. 6, simulations of fluid mechanics on industrial configurations show that when the strip 33 is inclined, the resultant of the pressures exerted on the strip exerts torque T tending to incline the strip even more, and thus to move the edges of the strip towards the boxes. The system is thus likewise unstable, and there is no tendency for the strip to be stabilized on a line of travel that is centered between the boxes. The results of FIGS. 5 and 6 have been demonstrated by software for simulating fluid mechanics, and by calculating the resultant of the pressures exerted on each face of the strip. The resultant of the pressures exerted on each face of the strip is the resultant of positive pressures in zones that are substantially in register with the blow tubes and of negative pressures in register with portions that are not situated in register with said tubes.

As described in document WO-A-01/09397, proposals have been made to channel the flow of blown gas by providing for the blow tubes to be inclined towards the edges of the strip, mainly for the purpose of improving cooling, however modeling reveals only a small improvement in the effects shown diagrammatically in FIGS. 5 and 6.

U.S. Pat. No. 6,054,095 also teaches inclining the blow tubes of the boxes towards the edges of the strip, but for the purpose of obtaining better treatment uniformity in the strip, and thus without being concerned about the stability of said strip while it travels. In a variant, U.S. Pat. No. 4,673,447 describes the use of blow boxes having holes, said holes being arranged through a plate that is thick so as to impart inclinations to the jets of gas. It should be observed that the jets are inclined not towards the edges, but on the contrary towards a midplane, symmetrically about said plane. That thus constitutes more of a mere stabilizing skid.

Document EP-A-1 108 795 describes a variant of the above techniques in which boxes are used that have straight blow tubes (perpendicular to the plane of the strip). The idea is merely to modify the intensity of cooling by acting on the lengths of the tubes, which tubes are selected to be shorter near the edges of the strip.

Document EP-A-1 029 933 describes another variant with boxes having nozzles in the form of blades. The transverse blades do not produce any inclined jets, and the boxes do not make it possible to organize recovery of the blow gas perpendicularly to the strip, as already mentioned above.

In another design, and in order to limit the flow of gas in a direction parallel to the travel direction of the strip, a solution in widespread use is as shown in FIGS. 7 and 8 (FIG. 8 being a section on VIII-VIII of FIG. 7). That solution consists in using tubular blow nozzles 41 each having an axis 48, two end walls 46, and a gas inlet 47, said nozzles being pierced by respective pluralities of circular holes 42 that are oblong or slot-shaped, enabling jets 45 to be blown against the strip 43 traveling in the direction 100. Even if the confinement between the strip 43 and the blow nozzles 41 is smaller than in arrangements making use of boxes having tubes, and does enable a certain amount of gas to be recovered in a direction normal to the plane of the strip between the blow nozzles, that confinement leads to pressure effects that are most unfavorable, leading to the same phenomena as those described with reference to FIGS. 5 and 6. That result can be demonstrated by modeling the suctions created by that configuration, and the strip is not stabilized on an optimum line of travel, i.e. a line centered between the blow nozzles.

Finally, document EP 1 067 204 A1 describes a solution for suppressing vibration by adjusting the pressure and/or the flow rate of gas that is blown transversely relative to the strip. In addition to the complexity of the adjustment that needs to be adapted to each product for treatment, that method presents two major drawbacks. Firstly, the strip can be caused to depart from being parallel with the blow devices, thereby reducing the distance between the strip and the device and increasing the risk of contact. Finally, cooling capacity is not maximized, and the reduction in the speed and/or pressure against one face cannot be compensated by an increase in the speed or the pressure of the jets against the other face if the limits on speed or on blow capacity have already been reached.

BRIEF SUMMARY OF THE INVENTION

The invention seeks to propose a method of cooling that simultaneously optimizes the thermal aspects and the air flow aspects, i.e. that maximizes cooling while minimizing vibration or offsets of the strip by providing a self-centering effect that tends to return the strip onto an ideal line of travel in the event of it being offset or being turned relative to its theoretical line of travel.

The fundamental principles of the approach of the invention consist in combining the advantages of minimized confinement and a limit on the flow of gas in a plane parallel to the strip, with blowing being optimized by directed jets that serve both to provide the strip with cooling and with stability.

This approach thus excludes the prior solutions that make use of cooling boxes (shown in FIGS. 4 to 6) which by their very nature necessarily limit the volume available between the strip and the boxes (even when blow tubes are added thereto).

This approach is also very remote from prior solutions using blow nozzles pierced by holes (as shown in FIGS. 7 and 8) that leave a large amount of confinement between the strip and the nozzles. Furthermore, the normally small wall thickness of the blow nozzles does not enable the jets to be directed merely by piercing or machining blow nozzles.

The above technical problem is solved in accordance with the invention by means of a method of improving the cooling of a blown-gas cooling chamber or of a blown-air cooling section in a line for heat treating steel and/or aluminum, and/or of improving the quality of products for treatment by reducing the vibration generated by the cooling, in which jets of gas or air are projected against each of the faces of the strip traveling through said section or chamber, the jets of gas or air being emitted from blow tubes fitted to tubular nozzles arranged at a distance transversely on either side of the travel direction of the strip, said jets being directed towards the corresponding face of the strip while being inclined simultaneously essentially towards the edges of said strip in a plane perpendicular to the panel of the strip and to the travel direction of said strip, and towards the upstream or downstream end of the strip in a plane perpendicular to the plane of the strip and parallel to the travel direction of said strip.

Advantageously, the jets of gas or air emitted from a single tubular nozzle are inclined both towards the upstream end and towards the downstream end of the strip. This provides better blowing efficiency for a given number of tubular nozzles.

Also preferably, the distance between two adjacent tubular nozzles on the same side of the strip is selected in such a manner that the points of impact of the jets of gas or air on the strip are substantially equidistant in a direction parallel to the travel direction of said strip. This is most favorable for stability of the strip while it is traveling.

Also advantageously, the jets of gas or air emitted from a given tubular nozzle are inclined essentially towards the edges of the strip in such a manner that the points of impact of said jets on said strip are substantially equidistant in a direction perpendicular to the travel direction of the strip. In particular, the jets of gas or air emitted from a given tubular nozzle are inclined essentially towards the edges of the strip at an inclination that increases going from the midline of the strip towards the edges of said strip from about 0° to an angle of less than 15°.

Also preferably, the jets of gas or air are organized to present a jet distance that is substantially constant regardless of their angle of inclination.

The invention also provides apparatus for implementing a method of improvement presenting at least one of the above characteristics, said apparatus being remarkable in that it includes a plurality of tubular nozzles on either side of the traveling strip, the nozzles being arranged at a distance from one another transversely to the travel direction of the strip, each tubular nozzle being fitted with blow tubes pointing towards a face of the strip, said blow tubes being inclined both essentially towards the edges of said strip in a plane perpendicular to the plane of the strip and to the travel direction of said strip, and towards the upstream end or downstream end of the strip in a plane perpendicular to the plane of the strip and parallel to the travel direction of said strip.

It is advantageous to provide for each tubular nozzle to be fitted with two rows of blow tubes, the tubes of one row being inclined upstream while the tubes of the other row are inclined downstream, preferably at the same angle of inclination. In particular, the distance between two adjacent tubular nozzles on the same side of the strip is selected in such a manner that the points of impact of the jets emitted from the rows of blow tubes are substantially equidistant in a direction parallel to the travel direction of said strip.

In which case, and advantageously, the blow tubes of each row of a given tubular nozzle are inclined essentially towards the edges of the strip in such a manner that the points of impact of the jets emitted from the blow tubes of said row are substantially equidistant in a direction perpendicular to the travel direction of said strip. In particular, the blow tubes of a given row are inclined essentially towards the edges of the strip at an angle of inclination that increases from the midline of the strip going towards the edges of said strip from about 0° to an angle of less than 15°.

Also preferably, the blow tubes of each tubular nozzle are dimensioned lengthwise in such a manner that the jets of gas or air emitted by said tubes present a jet distance that is substantially constant regardless of their angle of inclination.

Finally, provision could be made for the tubular nozzles to have a section that is circular, oblong, triangular, square, rectangular, or polygonal.

Other characteristics and advantages of the invention appear more clearly in the light of the following description of a particular embodiment, given with reference to FIGS. 9 and 10, FIG. 9 being a section on IX-IX of FIG. 10.

DETAILED DESCRIPTION OF THE INVENTION

Fundamentally, the means implemented by the invention in a cooling zone or chamber consist in combining the technical effects listed below:

- making it possible to recover the blown gas after impact against the strip in a direction that is substantially normal to the plane of the strip by using blow nozzles that are preferably circular, oblong, square, rectangular, or polygonal in section, thus enabling the blown gas to be recovered through the spaces situated between the nozzles;
- limiting the confinement between the strip and the blow devices by increasing the volume available between the blow nozzles and the strip so as to have a return force (or toque) tending to return the strip to its ideal line of travel in the event of it presenting any offset (or any rotation) relative to the ideal line of travel, and to do so without increasing the blow distance. This limiting of the confinement can be achieved by increasing the distance between the strip and the nozzles without increasing the blow distance by using hollow blow tubes that are secured to the nozzles in one or more rows; and
- channeling or guiding the blow jets towards the edges of the strip so as to have a return force (or torque) tending to return the strip to its ideal line of travel in the event of it becoming offset (or being subjected to any rotation) relative to its ideal line of travel. Orienting the jets in this way by inclining all or some of the tubes relative to the normal to the plane of the strip is compatible with optimized cooling, i.e. with a mesh of blown gas impact points that is substantially constant and with a blow distance that is substantially constant.

Thus, both the cooling and the stability of the strip are optimized.

Figure 9:
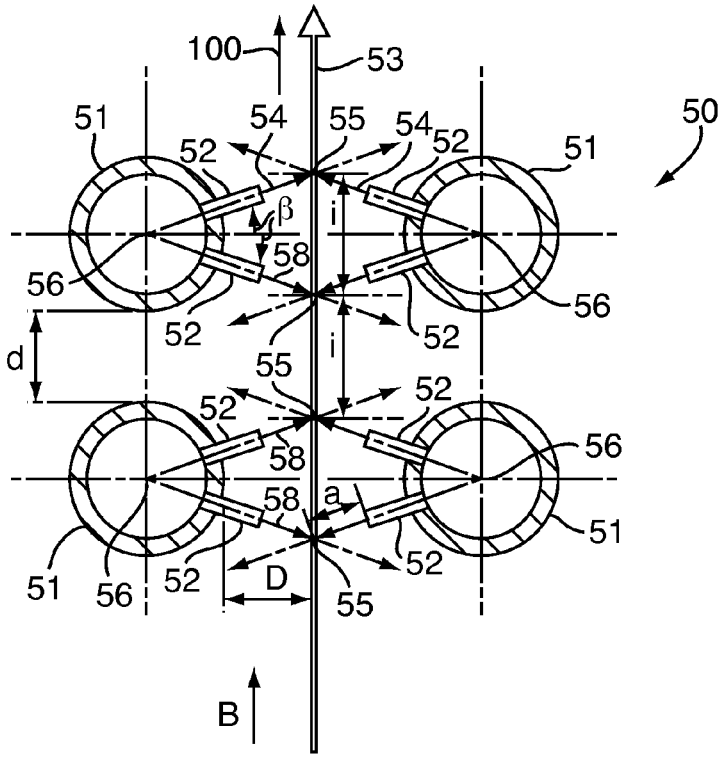
FIG. 9 shows a side view of a cross section along line IX-IX of a cooling device having two pairs of tubular blow nozzles each having respective pairs of blow tubes situated on either side of a strip in accordance with an embodiment of the present invention.
Figure 10:
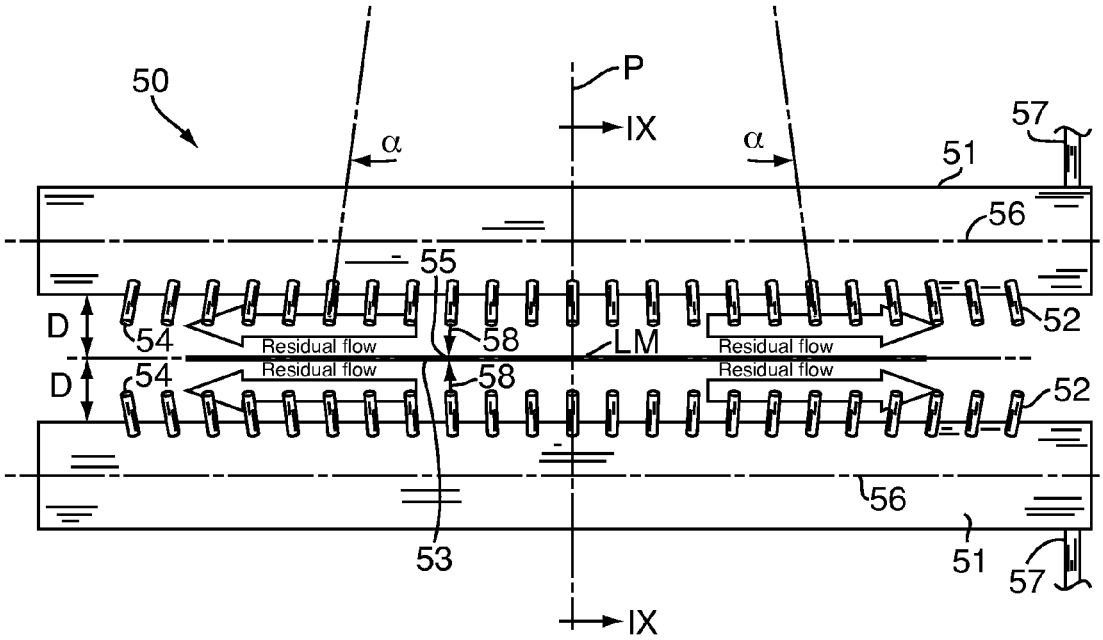
FIG. 10 illustrates a view of the cooling device and a strip including a simulation of the residual flow of air away from the center of the strip.

Reference is made below to FIGS. 9 and 10 while describing a particular embodiment of the invention in more concrete and detailed manner.

FIGS. 9 and 10 shows a cooling device 50 of which only two pairs of tubular blow nozzles 51 are shown, these blow nozzles being situated on either side of the strip 53 which travels in a travel direction referenced 100. The blow nozzles 51 are preferably circular in section as shown, having an axis 56, however in other embodiments of the invention, they could have a section that is oblong, triangular, square, rectangular, or polygonal.

Hollow blow tubes 52 are secured to the tubular nozzles 51. These tubes are disposed in one or more rows. The disposition and the number of the rows of blow tubes need to be designed to ensure a mesh of impact points on the strip that is substantially equidistant in order to optimize cooling and in order to limit the thermomechanical stresses exerted on the strip.

As shown in FIG. 9, the tubular nozzles 51 are disposed at a distance from one another transversely to the travel direction 100 of the strip, each tubular nozzle 51 being fitted with blow tubes 52 pointing towards one of the faces of the strip, in a disposition that is symmetrical relative to the plane of said strip so as to obtain impact points for the emitted jets 58 that match on both faces of the strip 53.

In accordance with a characteristic of the invention, the blow tubes 52 are inclined both essentially towards the edges of the strip 53 in a plane that is perpendicular to the panel of the strip and to the travel direction 100 of said strip (as can be seen in FIG. 10), and upstream or downstream relative to the strip 53 (relative to its travel direction) in a plane P that is perpendicular to the plane of the strip and parallel to the travel direction 100 of said strip (as can be seen in FIG. 9).

The term "essentially" as used above seeks to specify that a few blow tubes 52, close to the midline LM of the strip 53 may emit jets that are perpendicular to the plane of the strip, while the great majority of the blow tubes 52 nevertheless present an inclination at an angle a relative to the normal to the plane of the strip. This angle of inclination preferably increases going away from the midline LM of the strip towards the edges of said strip, from about 0° to an angle that is less than 15°.

The blow tubes 52 are specifically inclined towards the edges of the strip at an angle a lying in the range 0° to a maximum of about 15°, as shown in FIG. 10, which is a view looking along B in FIG. 9. This angle of inclination can apply to all or some of the tubes depending on the particular embodiment of the invention. This makes it possible to channel the residual gas flow (i.e. the flow that is not exhausted in a rearward direction perpendicular to the plane of the strip after exchanging heat with said strip) along preferred directions heading towards the edges of the strip and tending to stabilize said strip.

One of the cooling performance parameters is blow distance, i.e. the distance of the emitted jet 58 between the free end 54 of a tube 52 and the corresponding point of impact 55 on the strip, for the jet emitted by that tube. In order to conserve uniform cooling capacity over the strip regardless of the angle of inclination of the tubes, the length of each tube 52 may be determined as a function of its angle of inclination so as to have jet distances that are substantially constant, and thus obtain uniform cooling capacity. In practice, the tubes become longer with increasing angle of inclination a. Numerical modeling has shown that an optimum stabilizing effect is obtained when the angle of inclination of the tube remains less than 15° towards the edges of the strip.

Numerical modeling of this configuration reveals a self-stabilizing effect in the event of the strip being offset or turned relative to the ideal line of travel. The resultant of the pressures therefore tends to return the strip to the center.

It should be observed that the return of the strip in position is achieved in natural manner without any particular adjustment, and without any action by an operator or a computer, and that the optimum cooling capacity is preserved.

In FIG. 10, reference D designates the distance between the tubular nozzles 51 and the strip 53. This distance D is greater than the distance that used to exist with nozzles merely having holes at equal blow distances.

The blow tubes 52 are also inclined towards the upstream or downstream end of the strip 53 in a plane perpendicular to the panel of the strip and parallel to the travel direction 100 of said strip.

Provision can be made for the tubular nozzles 51 to have a single row of blow tubes 52, pointing either downstream or upstream. For greater efficiency and better compactness, it is advantageous, as shown in FIG. 9, to provide for each tubular nozzle 51 to be fitted with two rows of blow tubes 52, the tubes in one row being inclined upstream while the tubes in the other row are inclined downstream, and preferably with the same angle of inclination written b.

The points of impact 55 of the jets 58 emitted from the two rows of tubes 52 of each tubular nozzle 51 are spaced apart by a distance written i. It is then advantageous to select the distance d between two adjacent tubular nozzles 51 situated on the same side of the strip 53 to be such that all of the points of impact 55 are equidistant (distance i). This serves to provide a mesh of the blow points of impact 55 that is regular and optimized. This distance d then allows optimum recovery of the gas in a direction that is substantially normal to the plane of the strip, thereby having the effect of reducing any pressure reductions that might exist between the impact zones.

Finally, it is advantageous to provide for all of the blow tubes 52 to be dimensioned lengthwise so that the jets 58 of gas or air presents a jet distance a (between the outlet orifice 54 of a tube 52 and the corresponding point of impact 55) that is substantially constant regardless of their angle of inclination.

This ensures that cooling power is delivered in a manner that is distributed completely uniformly over the portion of the strip that is subjected to the jets of gas or of air.

Figure 1:
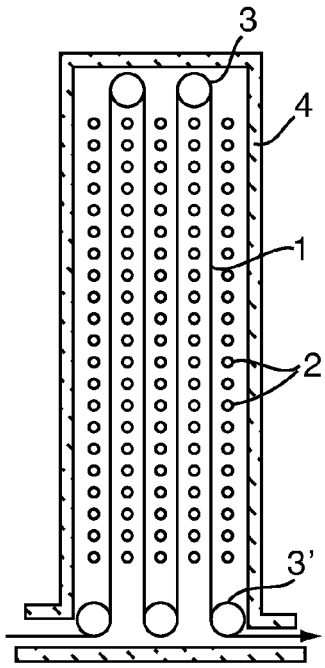
FIG. 1 Prior Art
FIG. 1 is a schematic diagram of a side view of a cross section of a vertical cooling chamber of a line for applying treatment of strips of metal in accordance with the prior art.
Figure 2:
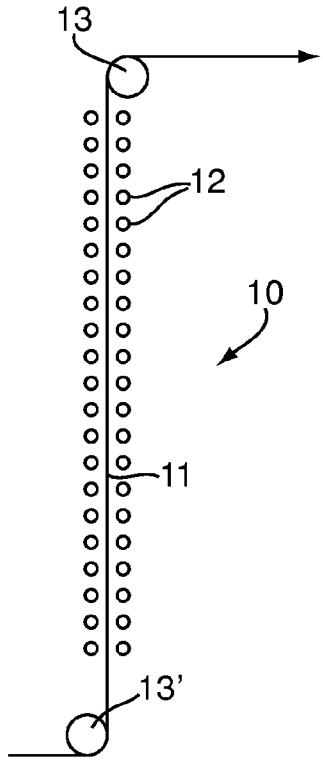
FIG. 2 Prior Art
FIG. 2 is a schematic diagram of a side view of a cross section of a vertical cooling section of a line of travel for strips of metal made in accordance with the prior art.
Figure 3:
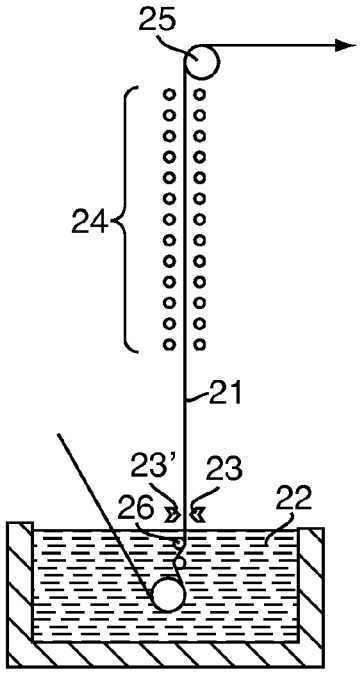
FIG. 3 Prior Art
FIG. 3 is a schematic diagram of a side view of a cross section of a post-coating cooling zone in a hot galvanization line in accordance with the prior art.
Figure 4:
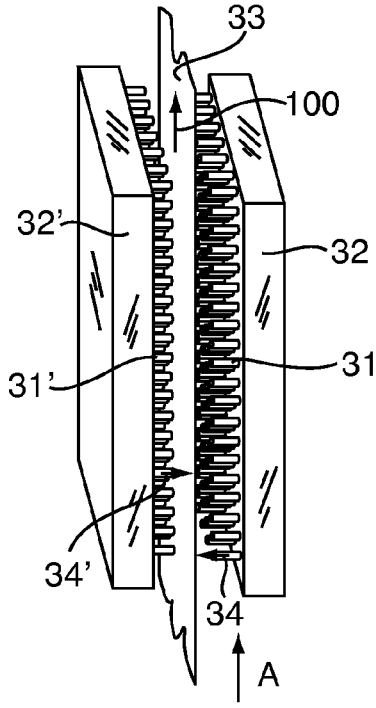
FIG. 4 Prior Art
FIG. 4 is a perspective view of an arrangement of blow tubes on blow boxes situated on either side of a strip in accordance with the prior art.
Figure 5:
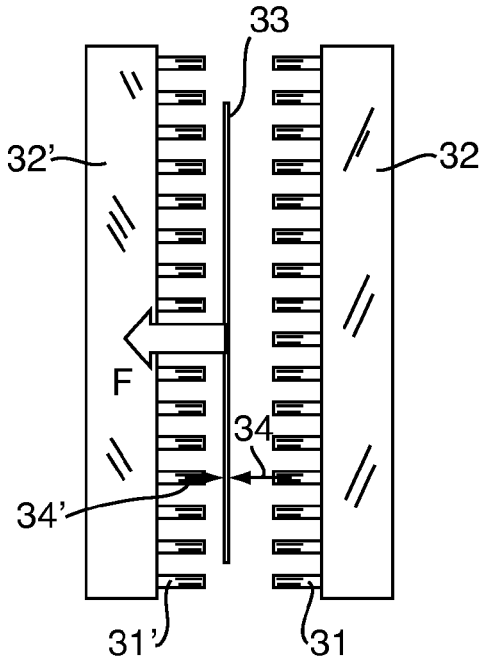
FIG. 5 Prior Art
FIG. 5 illustrates a simulation of the force applied to a strip treated by the arrangement of FIG. 4.
Figure 6:
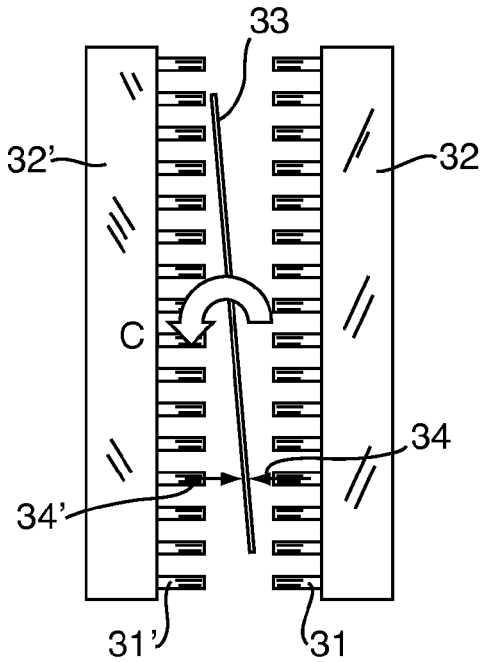
FIG. 6 Prior Art
FIG. 6 illustrates a different simulation of the torque applied to a strip treated by the arrangement of FIG. 4.
Figure 7:
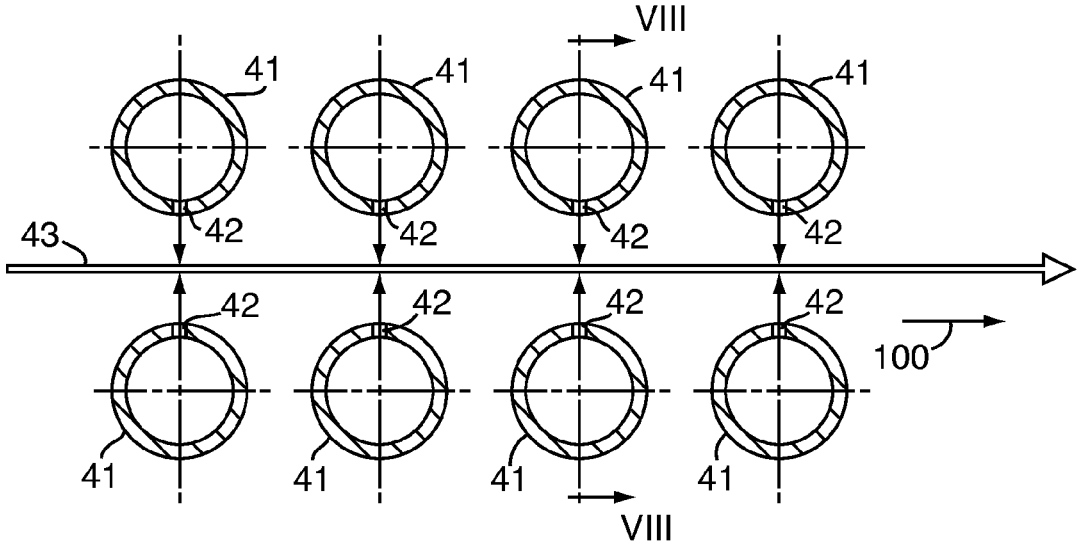
FIG. 7 Prior Art
FIG. 7 shows a side view of a cross section of tubular blow nozzles each being pierced by respective circular holes situated on either side of a strip in accordance with the prior art.
Figure 8:
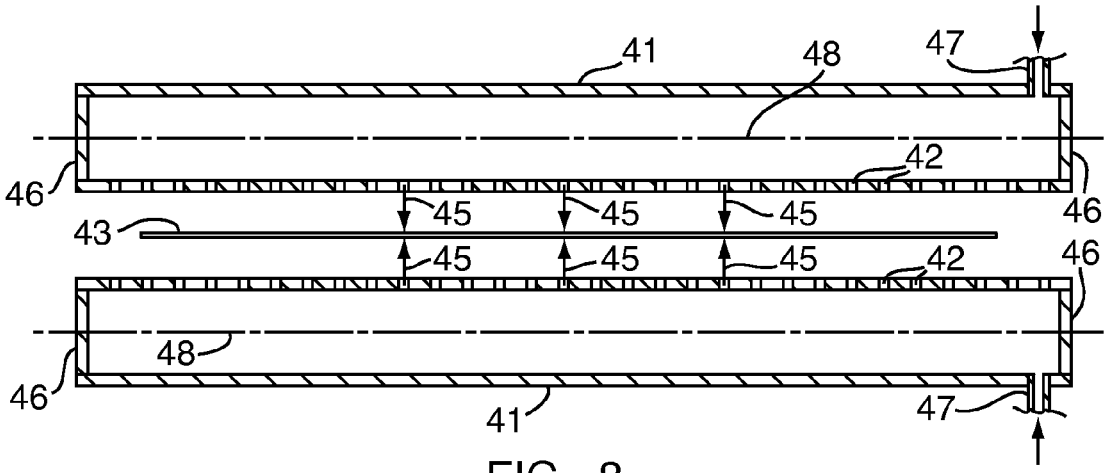
FIG. 8 Prior Art
FIG. 8 shows a front view of a cross section of the tubular blow nozzles and the strip of FIG. 7.

The invention provides the very important advantages that are summarized below:

- an increase in line productivity by applying a cooling capacity that is greater than that of conventional solutions, and without the strip vibrating;
- an increase in quality and in productivity by guaranteeing that the strip is not marked by making contact due to vibration (with associated consequences in terms of producing seconds, slowing down the line, or breaking the strip);
- an increase in flexibility by omitting any adjustment and/or action seeking to reduce the appearance of vibration of the kind used in traditional solutions; and
- an increase in the capacity of installations: the method reduces vibration while optimizing cooling, thus making it possible to reduce the distance between supports for the strip inside cooling zones or chambers. An example of an advantage that is particularly important is the possibility of reducing the height of cooling towers after hot galvanization as shown in FIG. 3.

The invention is not limited to the embodiments described above, but on the contrary covers any variant using equivalent means to reproduce the central characteristics specified above.

What is claimed is:

1. A method of improving the cooling of a blown-gas cooling chamber or of a blown-air cooling section in a line for heat treating steel and/or aluminum, and/or of improving the quality of products for treatment by reducing the vibration generated by the cooling, in which jets of gas or air are projected against each of the faces of a strip traveling through the section or chamber, wherein the jet of gas or air are emitted from blow tubes fitted to tubular nozzles arranged at a distance transversely on either side of the travel direction of the strip, the jets being directed towards the corresponding face of the strip while being inclined simultaneously essentially towards the edges of the strip in a plane perpendicular to a panel of the strip and to the travel direction of the strip, and towards the upstream or downstream end of the strip in a plane perpendicular to the plane of the strip and parallel to the travel direction of the strip, wherein the jets of gas or air emitted from a single tubular nozzle are inclined both towards the upstream end and towards the downstream end of the strip.

2. The method according claim 1, wherein the distance (d) between two adjacent tubular nozzles on the same side of the strip is selected in such a manner that the points of impact of the jets of gas or air on the strip are substantially equidistant in a direction parallel to the travel direction of the strip.

3. The method according to claim 1, wherein the jets of gas or air emitted from a given tubular nozzle are inclined essentially towards the edges of the strip in such a manner that the points of impact of the jets on the strip are substantially equidistant in a direction perpendicular to the travel direction of the strip.

4. The method according claim 3, wherein the jets of gas or air emitted from a given tubular nozzle are inclined essentially towards the edges of the strip at an inclination that increases going from the midline of the strip towards the edges of the strip from about 0° to an angle of less than 15° .

5. The method according to claim 1, wherein the jets of gas or air are organized to present a jet distance (a) that is substantially constant regardless of their angle of inclination.

6. An apparatus for implementing a method of improving the cooling of a blown-gas cooling chamber or of a blown-air cooling section in a line for heat treating steel and/or aluminum, and/or of improving the quality of products for treatment by reducing the vibration generated by the cooling, in which jets of gas or air are projected against each of the faces of a strip traveling through the section or chamber, wherein the jet of gas or air are emitted from blow tubes fitted to tubular nozzles arranged at a distance transversely on either side of the travel direction of the strip, the jets being directed towards the corresponding face of the strip while being inclined simultaneously essentially towards the edges of the strip in a plane perpendicular to a panel of the strip and to the travel direction of the strip, and towards the upstream or downstream end of the strip in a plane perpendicular to the plane of the strip and parallel to the travel direction of the strip, the apparatus including a plurality of tubular nozzles on either side of the traveling strip, the nozzles being arranged at a distance from one another transversely to the travel direction of the strip, each tubular nozzle being fitted with blow tubes pointing towards a face of the strip, the blow tubes being inclined both essentially towards the edges of the strip in a plane perpendicular to the plane of the strip and to the travel direction of the strip, and towards the upstream end or downstream end of the strip in a plane perpendicular to the plane of the strip and parallel to the travel direction of the strip, wherein each tubular nozzle is fitted with two rows of blow tubes, the tubes of one row being inclined upstream while the tubes of the other row are inclined downstream.

7. The apparatus according to claim 6, wherein the distance (d) between two adjacent tubular nozzles on the same side of the strip is selected in such a manner that the points of impact of the jets emitted from the rows of blow tubes are substantially equidistant in a direction parallel to the travel direction of the strip.

8. The apparatus according to claim 6 wherein the blow tubes of each row of a given tubular nozzle are inclined essentially towards the edges of the strip in such a manner that the points of impact of the jets emitted from the blow tubes of the row are substantially equidistant in a direction perpendicular to the travel direction of the strip.

9. The apparatus according to claim 8, wherein the blow tubes of a given row are inclined essentially towards the edges of the strip at an angle of inclination that increases from the midline of the strip going towards the edges of the strip from about 0° to an angle of less than 15° .

10. The apparatus according to claim 6, wherein the blow tubes of each tubular nozzle are dimensioned lengthwise in such a manner that the jets of gas or air emitted by the tubes present a jet distance (a) that is substantially constant regardless of their angle of inclination.

11. The apparatus according to claim 6, wherein the tubular nozzles are circular, oblong, triangular, square, rectangular, or polygonal in section.

12. The apparatus according to claim 6, wherein the tubes of the one row and the tubes of the other row are inclined at the same angle of inclination.

* * * * *